United States Patent [19]

DeSantis

[11] Patent Number: 4,543,896

[45] Date of Patent: Oct. 1, 1985

[54] DEVICE FOR ADJUSTING THE TRAJECTORY OF THE UPPER LOOPER IN AN OVERLOCKING SEWING MACHINE

[75] Inventor: Gennaro DeSantis, Vigevano, Italy

[73] Assignee: Rockwell-Rimoldi S.p.A., Italy

[21] Appl. No.: 611,641

[22] Filed: May 18, 1984

[30] Foreign Application Priority Data

Apr. 17, 1984 [IT] Italy ..... 23703/83[U]

[51] Int. Cl.[4] ..... D05B 1/18; D05B 57/06

[52] U.S. Cl. ..... 112/162; 112/199

[58] Field of Search ..... 112/165, 166, 197, 199, 112/269.1, 162

[56] References Cited

U.S. PATENT DOCUMENTS 3,670,677 6/1972 Hirayama ..... 112/199

3,952,674 4/1976 Hirayama ..... 112/199

*Primary Examiner*—Wm. Carter Reynolds

[57] ABSTRACT

An improved device for changing the trajectory of the upper looper in an overlocking stitching machine in which the looper carrying rod slides in a cylindrical element contained within a support body having support means located at different distances from the rocking axis of the cylindrical element so that the position of support body can be reversed to change the path of the looper trajectory.

2 Claims, 3 Drawing Figures

DEVICE FOR ADJUSTING THE TRAJECTORY OF THE UPPER LOOPER IN AN OVERLOCKING SEWING MACHINE

This invention relates to a device for adjusting the trajectory of the upper looper in overlocking sewing machines in accordance with the fabric thickness and the width of the overlock stitch, in order to obtain correct phasing between the upper looper, the lower looper and the needle.

It is well known that the upper looper movement is obtained by means of a rod which supports said looper and is made to slide reciprocatingly along a guide which is itself pivoted. Adjustment of the looper trajectory in accordance with the fabric thickness, i.e., varying the height of said trajectory relative to the sewing machine needle plate, is obtained in the known art by the adjustment device described in U.S. Pat. No. 3,952,674, in which the slide guide for the looper carrying rod is moved horizontally while the position of the pivot remains unchanged. In this manner the trajectory of the upper looper can be lengthened or shortened. A further device is described in U.S. Pat. No. 3,670,677 for adjusting the inclination of the trajectory of the upper looper in order ot obtain correct positioning of this latter relative to the lower looper and needle, this adjustment being obtained by horizontally moving the rod slide guide in one direction or the other, rigid with the pivot.

As can be seen from the known art, which is constituted by the aforesaid patents, in order to obtain the two described adjustments it is necessary to use two separate devices, which cannot be combined in a single machine and which are of a complexity which makes them not easy to use and of uneconomical construction.

The object of the present invention is to provide a single support for the looper carrying rod which is suitable for all the travel strokes required by the different sewing operations on various fabrics, from the lightest to the heaviest, and such as to be able to obtain the correct phasing between the upper looper, the lower looper and the needle.

The technical problem relative to this object was to provide an adjustment device for the upper looper trajectory in which it is possible to move the rocking axis of the support pivot upwards or downwards in order to increase or respectively decrease the amplitude of the trajectory in relation to the fabric thickness and the width of the overlock rib, and in which it is also possible to move said axis towards or away from the needle trajectory and the lower looper trajectory in order to establish the ideal points of encounter with the lower looper and with the needle.

The solution to said technical problem is attained by providing a device for adjusting the trajectory of the upper looper in an overlocking sewing machine, comprising a cylindrical element with a diametrical bore in which the looper carrying rod is disposed, said cylindrical element being disposed in a support body having two opposing slots in which said looper carrying rod moves, wherein said support is provided with two horizontal rectilinear slots in which are engaged two pins which can be fixed in their turn to the machine frame, the slot axes being at different distances from the horizontal plane passing through the rocking axis of said cylindrical element, the difference between said distances being equal to the displacement in height of the rocking axis of said cylindrical element on rotating said support through 180° with positional change-over of said horizontal slots.

The characteristics and advantages of the present invention will be apparent from the description of the extent of the present invention given hereinafter by way of non-limiting example with reference to the accompanying drawings, in which.

Figure 1:
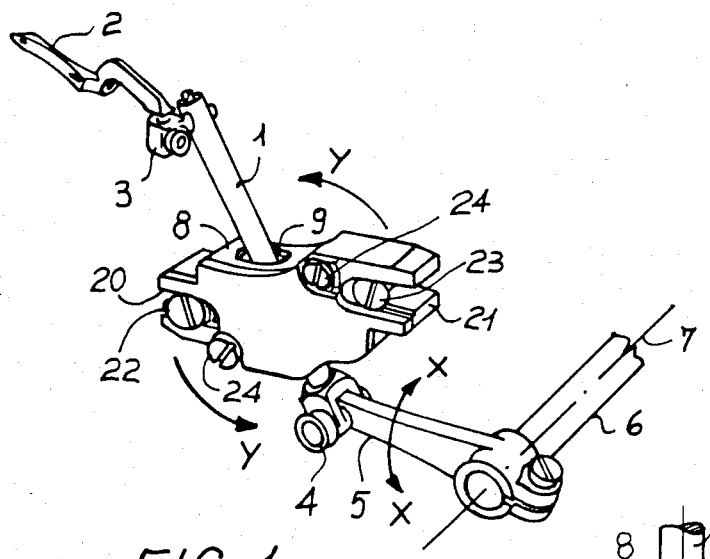
FIG. 1 is a perspective view of the device.
Figure 3:
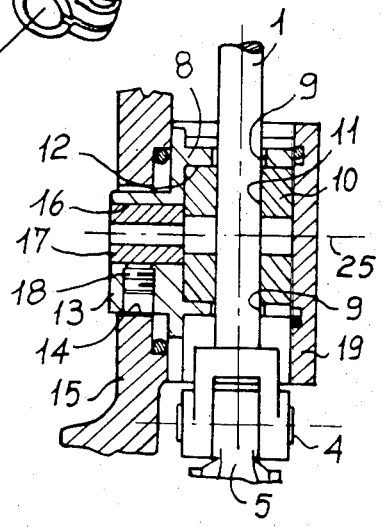
FIG. 3 is a section on the line III—III of FIG. 2.
Figure 2:
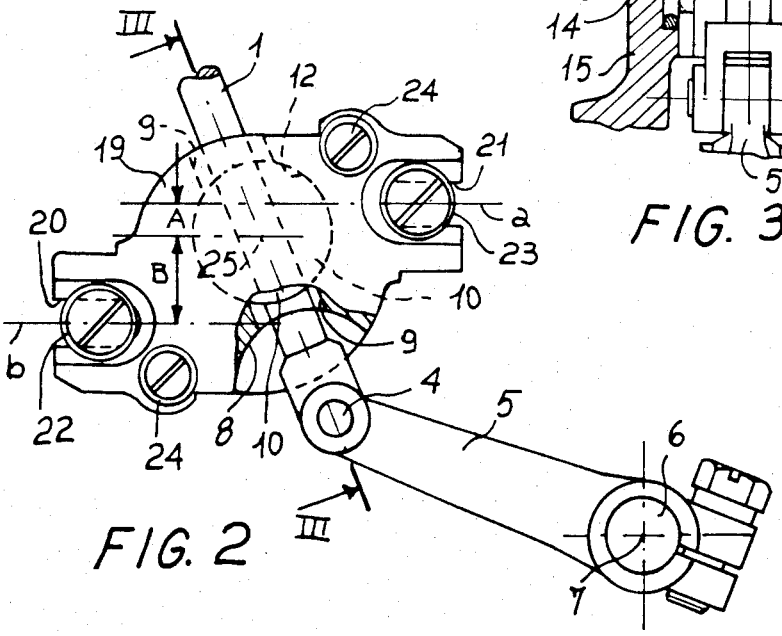
FIG. 2 is a selection on a vertical plane passing along the major axis of the device of FIG. 1.

At its upper end the rod 1 fixedly carries the upper looper 2 by means of the clamp 3, whereas lowerly it is pivoted by the pin 4 to the lever 5 which in known manner is subject to rocking movement in accordance with the arrows X—X by the shaft 6 which rocks about its axis 7.

The support body 8 for the device according to the invention is provided with two opposing slots 9 through which the rod 1 passes. Said support body 8 has a cylindrical element 10 within it that is provided with a diametrical through bore 11 in which the rod 1 slides.

Said support body 8 also has a cylindrical seat 12 terminating in the projected portion 13 that is received in the opening 14 provided in the sewing machine frame 15.

The projecting portion 13 internally comprises an axial bore 16 in which an adjustment pin 17 is inserted, locked by a screw 18 screwed into said portion 13.

The adjustment pin 17 serves as a shoulder for the cylindrical element 10 in opposition to the cover 19 of the support 8, in order to take-up the inevitable play produced by wear.

Said support 8 is provided with two open horizontal slots 20 and 21 in which two threaded pins 22 and 23 are respectively engaged, and are fixable to the sewing machine frame 15. The purpose of the other two screws 24 is to fix the cover 19 to the support 8 so as to retain the cylindrical element 10 in its seat 12.

The distance A between the axis a of the slot 21 and the horizontal plane passing through the rotational axis 25 of the cylindrical element 10 is less than the distance B between said plane and the axis b of the slot 20. As will be seen hereinafter, arranging the parts in this manner serves for making the fine adjustments to the movement of the rod 1.

The device operates in the following manner: in order to adjust the looper trajectory in accordance with the fabric thickness, i.e., to vary the height of the rocking axis 25 of the cylindrical element 10, the screws 22 and 23 are unscrewed, the rod 1 is withdrawn from the support body 8 and the support body 8 is rotated through 180° in accordance with the arrows Y—Y starting from the position of FIG. 1, in order to reduce the amplitude of the looper trajectory, i.e., in such a manner that this approaches the sewing machine needle plate.m In this manner, the positions of the slots 20 and 21 reverse, namely the slot 20 attains a position corresponding with the screw 23, and the slot 21 attains a position corresponding with the screw 22. Having made this rotation, the screws 22 and 23 are again screwed down. In order to again raise the rocking axis of the element 10, the support body 8 is returned from this position to the position of FIG. 1. When it is required to give different angular positions to the rod 1 carrying the upper looper 2 in order to find the ideal points of encounter of the upper looper 2 with the lower looper and with the needle (not shown in the figure), the support 8 is slid horizontally along the screws 22 and 23 by means of the slots 20 and 21. To make minor adjustments with trajectory of the looper, the screws 22 and 23 are loosened and the support body 8 is adjusted either toward the right or toward the left, as desired, and the screws are then realigned.

This arrangement therefore makes it possible to cause the upper the upper looper to assume all possible adjustments for any type of fabric, from the lightest to the heaviest, and to obtain the correct phasing with the other sewing members, all this being attained with a single support for the looper rod.

A preferred embodiment of the present invention has been described, and modifications can be made to the device heretofore described but without leaving the scope of the present invention.

I claim:

1. A device for adjusting the trajectory of the upper looper in an overlocking sewing machine, comprising a cylindrical element with a diametrical bore in which the looper carrying rod is disposed, said cylindrical element being disposed for rocking about an axis in a support body having two opposing slots in which said looper carrying rod moves, characterized in that said support is provided with two horizontal rectilinear slots in which there are engaged two pins which can be fixed in their turn to the machine frame, the slot axes being at different distances from the horizontal plane passing through the rocking axis of said cylindrical element, the difference between said distances being equal to the displacement in height of the rocking axis of said cylindrical element on rotating said support through 180° with positional change-over of said horizontal slots.

2. A device as claimed in claim 1, characterized in that said horizontal rectilinear slots are arranged to slide horizontally and are positionable by said pins in order to cause said rod to assume different angular positions.

* * * * *